US011098412B2

(12) United States Patent
Rafailovich et al.

(10) Patent No.: US 11,098,412 B2
(45) Date of Patent: Aug. 24, 2021

(54) APPARATUS AND METHOD FOR THE CONTINUOUS METALLIZATION OF AN OBJECT

(71) Applicant: AIRBUS DEFENCE AND SPACE GMBH, Taufkirchen (DE)

(72) Inventors: Lidija Rafailovich, Vienna (AT); Sonja Nixon, Taufkirchen (DE); Catherine Haas, Taufkirchen (DE); Tomislav Trišovic, Belgrade (RS); Hans Peter Karnthaler, Vienna (AT)

(73) Assignee: Airbus Defence and Space GmbH, Taufkirchen (DE)

( * ) Notice: Subject to any disclaimer, the term of this patent is extended or adjusted under 35 U.S.C. 154(b) by 0 days.

(21) Appl. No.: 16/353,459

(22) Filed: Mar. 14, 2019

(65) Prior Publication Data

US 2019/0284713 A1 Sep. 19, 2019

(30) Foreign Application Priority Data

Mar. 16, 2018 (DE) ..... 10 2018 106 195.1

(51) Int. Cl.
*C25D 5/54* (2006.01)
*C25D 5/04* (2006.01)
(Continued)

(52) U.S. Cl.
CPC ..... *C25D 5/54* (2013.01); *C25D 5/04* (2013.01); *C25D 7/04* (2013.01); *C25D 17/005* (2013.01);
(Continued)

(58) Field of Classification Search
CPC combination set(s) only.
See application file for complete search history.

(56) References Cited

U.S. PATENT DOCUMENTS 3,065,153 A * 11/1962 Hough ..... C25D 5/08 205/151
3,728,232 A * 4/1973 Morita ..... C25D 17/08 205/167
(Continued)

FOREIGN PATENT DOCUMENTS

DE 195 04 517 C1 8/1996
EP 1 010 779 A2 6/2000
(Continued)

OTHER PUBLICATIONS

European Search Report for Application No. 19162528.4 dated Oct. 4, 2019.
(Continued)

*Primary Examiner* — Ciel P Contreras
(74) *Attorney, Agent, or Firm* — Jenkins, Wilson, Taylor & Hunt, P.A.

(57) ABSTRACT

An apparatus and a method for the metallization of an object including placing the object in an electrolyte, placing an anode in contact with the electrolyte, placing a metallization contact of a cathode in contact with the object, applying an electrical tension between the anode and the cathode, wherein the metallization contact is displaced in relation to the object during the metallization of the object to achieve a complete and continuous metallization of the object's surface.

20 Claims, 5 Drawing Sheets

(51) Int. Cl.

| | |
|---|---|
| ***C25D 17/12*** | (2006.01) |
| ***C25D 7/04*** | (2006.01) |
| ***C25D 17/00*** | (2006.01) |
| ***C25D 17/06*** | (2006.01) |
| ***C25D 5/56*** | (2006.01) |
| *C25D 21/06* | (2006.01) |
| *C25D 21/18* | (2006.01) |

(52) U.S. Cl.
CPC ..... *C25D 17/06* (2013.01); *C25D 17/12* (2013.01); *C25D 5/56* (2013.01); *C25D 21/06* (2013.01); *C25D 21/18* (2013.01)

(56) References Cited

U.S. PATENT DOCUMENTS

| | | | |
|---|---|---|---|
| 4,096,042 | A | 6/1978 | Looney et al. |
| 5,932,081 | A | 8/1999 | Kopp et al. |
| 6,482,307 | B2 | 11/2002 | Ashjaee et al. |
| 2007/0278093 | A1 | 12/2007 | Barnard et al. |
| 2014/0190835 | A1 | 7/2014 | Kojima et al. |

FOREIGN PATENT DOCUMENTS

| | | | |
|---|---|---|---|
| EP | 1 369 099 | A2 | 12/2003 |
| EP | 1 493 847 | A2 | 1/2005 |
| EP | 3 178 970 | A1 | 6/2017 |
| FR | 1 585 272 | A | 1/1970 |
| WO | WO 2005/064043 | A2 | 7/2005 |

OTHER PUBLICATIONS

German Office Action for Application No. 10 2018 106 195.1 dated Nov. 21, 2018.
Partial European Search Report for Application No. 19162528.4 dated Jul. 25, 2019.
European Office Action for Application No. 19162528.4 dated Sep. 29, 2020.

* cited by examiner

APPARATUS AND METHOD FOR THE CONTINUOUS METALLIZATION OF AN OBJECT

CROSS-REFERENCE TO RELATED APPLICATION

This application claims priority to German Patent Application DE 10 2018 106 195.1 filed Mar. 16, 2018, the entire disclosure of which is incorporated by reference herein.

TECHNICAL FIELD

The disclosure herein relates to an apparatus and a method for the metallization of an object. The disclosure herein relates more specifically to an apparatus and a method for the metallization of an object providing an improved metallization of the object, in particular providing the possibility to obtain a continuous and homogenous metal coating on an object. The disclosure herein specifically relates to an electrolyser for the metallization of objects.

BACKGROUND

Complete, continuous metallization (or plating) of surfaces with complex geometries, especially their inner surfaces (or cavities) is a technical problem of special interest for industrial applications in the aerospace engineering field. It is for example very useful to the making of lightweight antennas for satellites where a light material such as a lightweight plastic material can be coated with an electrically conductive metal. It is also useful for parts that must be thermally insulating but electrically conductive, in particular for some cryo-technical applications.

A current beneficial method for metallizing objects is electroplating. Electroplating has many advantages such as allowing to metallize inner surfaces of an object, through the deposition process occurring in an electrolyte. Additional benefits of electroplating are speed and costs that make it attractive for industrial applications. However, until now electroplating had one important drawback: a complete coverage by the deposited material, i.e. continuous metallization, is not achievable. Indeed, no electrodeposition is occurring at the location of the electrical contact between the electrode and the object, necessary for plating. Therefore, the object having a non-metallized area is usually cropped to remove the non-metallized portion of the object where the electrode(s) contacted the object.

Other metallization techniques exist which do not request a physical contact between the apparatus for metallization and the object, such as physical and chemical vapour deposition or magneto sputtering. However, these techniques have important drawbacks when the object is to metallize cavities of an object. These techniques are also industrially expensive, in particular when large objects need to be plated, such as for example tubes with high aspect ratio.

Another contact-free deposition process to achieve metallization of objects with complex geometries is the electroless deposition obtained by fully immersing an object into an appropriate chemical bath. This technique has the advantage to provide a continuous metallic layer including on inner surfaces of an object. However, although the object is fully immersed in the bath during the electroless deposition process, in some cases such as when the metallization of objects with high aspect ratio is sought, cavities of the object are not fully treated. Additionally, as compared to electroplating, chemical deposition has important drawbacks arising from the need to continuously control the process. Another drawback of such technique is the high production costs due to the slow deposition rate. Also, layers obtained by chemical deposition are less dense and prone to the incorporation of impurities arising from the autocatalytic chemical reactions which reduce the quality and properties of the metallic layers. Therefore, the chemical deposition process is not beneficial for obtaining thick layers and it is therefore industrially mainly utilized for decorative purposes by thin layers.

Still, in the case of non-conductive materials it is possible to achieve positive results by combining both, the electroless deposition process and the electrodeposition one. By combining the chemical deposition providing in a first step a thin conductive layer followed in the second step by electroplating is a successful route to make metallization of objects. The desired thickness and quality of the metallic layer can be optimized by the operating parameters of the electroplating process.

SUMMARY

The disclosure herein aims to improve the metallization apparatuses and methods for metallizing or electroplating an object.

The disclosure herein aims to provide an apparatus and a method for obtaining a complete continuous metallization of an object, without metal-free portions on the surface of the object.

In particular the disclosure herein aims to provide an apparatus and a method avoiding the cropping of the metallized object.

The disclosure herein aims to obtain a method which is time and cost-efficient, even for large objects.

The disclosure herein proposes an apparatus for the metallization of an object comprising:

- a container adapted to contain an electrolyte and at least a portion of the object,
- a first electrode, and
- a second electrode comprising an electrical contact, called metallization contact, adapted to be electrically in contact with the object.

The apparatus is adapted to displace the metallization contact in relation to the object during the metallization of the object.

In the whole text, the term 'electrode' is used as a standard denomination for anode or cathode, therefore applying to an anode and/or a cathode.

In the whole text, the terms 'metallizing' and 'plating' and their derivatives are used equivalently to each other.

The object is beneficially completely immersed in the electrolyte so as to obtain a complete continuous layer of metal on the object's surface. The electrolyte is an electroplating solution comprising an electrolyte dissolved in an appropriate solvent.

The disclosure herein enables to obtain a continuous metal layer which covers the object completely, including in open cavities, concave portions or inner surfaces. The disclosure herein permits to obtain a result similar to a contact free electroplating technique, the generally accounted unplated area underneath the electrical contact needed for plating is avoided. This apparatus may in particular beneficially be used for the metallization of long tubes with high aspect ratio.

Compared to other deposition methods, such as for example vacuum deposition, sputtering or deposition from molten salts, the disclosure herein presents many advantages. The disclosure herein enables the metallization of objects with complex surface geometries, and/or objects comprising cavities, such as for example long tubes with high aspect ratios (>10).

The disclosure herein allows for a cost-efficient metallization of objects with little steps needed to metallize the complete surface of the object.

An electrolyte according to the disclosure herein is a liquid solution comprising electrolytic ions for the coating of an object.

The first electrode may be an anode, and the second electrode a cathode. The object may thus be the cathodic pole of the apparatus as being electrically connected to the cathode.

The apparatus is adapted to displace the metallization contact in relation to the object during the metallization of the object. Therefore the apparatus may be adapted to:

displace the metallization contact in relation to the object with the object being fixed in relation to other elements of the apparatus such as the container or a supporting frame of the apparatus, so that in such embodiments the metallization contact is mobile in relation to these other elements of the apparatus, and/or displace the object in relation to the metallization contact with the metallization contact being fixed in relation to other elements of the apparatus such as the container or a supporting frame of the apparatus, so that in such embodiments the object is mobile in relation to these other elements of the apparatus. This may be obtained by having a support for the object adapted to displace the object during the metallization.

The displacement between the metallization contact and the object during the metallization of the object may be of different types. The displacement may be:

a translation, a rotation around one or more axis, or any combination of translation(s) and rotation(s).

In some embodiments the apparatus may be adapted to displace the metallization contact towards the object's surface and away from the objects surface. Thereby the apparatus may be adapted to place the metallization contact in contact with the surface of the object and to separate the metallization contact from the object, so as to obtain an intermittent electrical contact between the object and the metallization contact. In particular the metallization contact may be displaced at least partially orthogonally to the local surface of the object at which the metallization contact may contact the object. The distance between the surface of the object and the metallization contact may thus be varied such that the metallization contact may be brought against the surface of the object and separated from the surface of the object at different steps of the metallization.

Thus the contact area of the surface of the object with the metallization contact may also be metallized while the metallization contact is separated from the object, provided that the apparatus comprises at least one second metallization contact which remains in contact with the object while the first metallization contact is separated from the object. The contacts between the object and the different metallization contacts may be alternated so that a complete and continuous metallization of an object may be obtained.

The apparatus may be adapted to displace the metallization contact along a surface of the object.

The metallization contact may be displaced along a surface of the object:

in translation, in rotation around one or more axis, or any combination of translation(s) and rotation(s).

Thus the contact area of the surface of the object with the metallization contact is moving during the metallization such that: at the beginning of the metallization the contact area is deprived of any metallization, but as the displacement along the surface happens, the metallization contact is brought to areas of the surface of the object which have at least partially already been metallized, while the first contact area is free of metallization contact and may itself be metallized. This permits to obtain a complete and continuous metallization of an object.

A combination of metallization contact(s) being displaced orthogonally to and along the surface of the object may also be envisaged within the scope of the disclosure herein.

The apparatus may further comprise an actuator adapted to actuate the metallization contact.

The actuator may be of different types. The actuator is beneficially adapted to the displacement to be made between the object and the metallization contact.

The actuator may be adapted to displace the metallization contact. The actuator may be adapted to displace the metallization contact at least partially orthogonally to the object's surface, so as to be adapted to bring the metallization contact in contact with and away from the objects surface. The actuator may be adapted to place the metallization contact in contact with the surface of the object and to separate the metallization contact from the object.

Alternatively or in combination the actuator may be adapted to displace the metallization contact along the object's surface.

The apparatus may further comprise a controller adapted to control the actuator.

The different phase of the metallization may therefore be better controlled.

Besides, the controller may be programmable, such that the metallization process may be at least partially automated. This provides a time and cost-efficient metallization process. The controller may for example comprise a computer comprising a program, connected to the one or more actuators so as to control their position.

A quasi contact free mode allows selective action of the sealed contacts distributed at the surface of the object during the electroplating of an (cf. FIG. 1). The manipulation of the electrical contacts provides a quasi-free electroplating.

The second electrode may comprise a plurality of metallization contacts.

An apparatus with a plurality of metallization contacts allows alternating the metallization contacts in contact with the object so as to obtain a continuous metal layer on the object's surface. A high number of metallization contacts allows to obtain a metal layer with a highly homogeneous thickness. Therefore, to obtain a high quality metallization with a high homogeneity of the thickness of the metal layer, one should use an apparatus according to the disclosure herein with a high number of metallization contacts.

An apparatus with a plurality of metallization contacts also allows, as will be further described, supporting the object with the metallization contact, such that the metallization contacts ensure at least two functions: electrical contact with the object and mechanical support of the object in the electrolyte.

By providing displaceable metallization contacts in relation to an object to be metallized and a plurality of metallization contacts, and more particularly a plurality of displaceable metallization contacts, the disclosure herein provides a combination of features which together provide an apparatus and a method adapted to obtain a metallized object with a continuous and homogeneous metallized layer in a single metallization process which can moreover easily be automated. In particular, the thickness variation of the electroplated layer encountered at the locations of the metallization contacts is minimized.

At least one metallization contact may be adapted to at least partially support the object.

The metallization contact(s) may be adapted to contact the surface of the object with a sufficient force to ensure a sufficient friction for the support of the object in place. The metallization contact(s) may be adapted to contact the surface of the object without damaging the object. This may be obtained by different characteristics of the metallization contact(s) such as: elasticity of the metallization contact, being held by a spring, a hydraulic actuator, a pneumatic actuator, an electric actuator, a magnetic actuator, etc. as well as surface characteristics of the metallization contact which may ensure sufficient friction with the object.

The metallization contact may be at least partially flexible. In particular the metallization contact may be at least partially elastic. This allows the metallization contact to adapt to objects of different sizes and shapes. Moreover this allows to apply a perpendicular force on the object without damaging the object if the Young modulus of the metallization contact is chosen smaller than the Young modulus of the object to be metallized.

The apparatus may further comprise:

- a first group of metallization contacts adapted to support together the object by contacting simultaneously the surface of the object,
- a second group of metallization contacts adapted to support together the object by contacting simultaneously the surface of the object.

At least one of the metallization contacts of the second group may be actuated independently from at least one of the metallization contacts of the second group. In some embodiments each metallization contacts of the second group may be actuated independently from each metallization contacts of the first group. In some embodiments the metallization contacts of the second group may be actuated simultaneously, for example with a common controller, independently from the metallization contacts of the first group.

The object may be supported alternatively by the first group of metallization contacts and by the second group of metallization contacts, such that the first group of metallization contacts supports the object in a first phase of the metallization of the object, and the second group of metallization contacts supports the object in a second phase of the metallization of the object. The support of the object may be ensured alternatively by the first and the second group of first group of metallization contacts during the metallization of the object in order to ensure a homogeneous metallization of the object.

The apparatus may comprise more than two independently actuated groups of metallization contacts.

The second electrode may comprise at least three metallization contacts, more particularly at least four metallization contacts, for example six or more metallization contacts.

The second electrode may comprise at least three, preferably at least 4, even more preferably at least six metallization contacts.

The multiple metallization contacts may be useful to maintain an object in the container. This supporting function ensured by the metallization contacts may be obtained by alternating contact between a first group of at least two metallization contacts arranged on two opposite sides of the object, and a second group of at least two metallization contacts arranged on two opposite sides of the object. Thus the contact between the first group and the object may be alternated with the contact between the second group and the object, so as to obtain a continuous metal layer on the object, while also ensuring the support of the object in the container, and more particularly in the electrolyte.

The apparatus may be adapted to displace a plurality of metallization contacts in relation to the object during the metallization of the object.

This may allow the alternating contact of the object's surface with a first group and a second group of metallization contacts. A plurality of metallization contacts may for example be displaced orthogonally to the object's surface so as to be brought in contact and separated from it alternatively during the metallization.

More specifically, a plurality of metallization contacts may be actuated.

The apparatus may comprise a support for supporting the object during the metallization of the object.

The apparatus is adapted to displace the metallization contact in relation to the support during the metallization of the object. The metallization contact may be displaced during the metallization and/or the support may be adapted to displace the object during the metallization.

In an apparatus according to the disclosure herein, the support may also be adapted to support an electrode. It may for example be adapted to support an anode. In particular the support may be adapted to support the object and the anode so as to ensure a predetermined distance between the anode and the object. The support may beneficially be made to maintain the anode in place and be electrically insulating.

In an apparatus according to the disclosure herein, the support may also be adapted to support the container. The support may form an end cap of the container, for example an end cap of a cylindrical container.

The support may also be fluid tight.

The support may comprise an inlet and/or outlet for an electrolyte fluid and a fluid circuit to place the container in fluid communication with the inlet and/or outlet, in particular when the support forms an end cap of the container.

The support may be replaced by or exert its function in combination with the metallization contacts ensuring a support of the object in the container by their mechanical contact with the object.

The apparatus may comprise a first anode and a second anode.

An apparatus comprising a plurality of anodes allows obtaining a continuous metallization of an object. An apparatus comprising a plurality of anodes is particularly beneficial to metallize object with complex shapes or important cavities, such as for example a tube.

The first anode may be adapted to be at least partially within a volume defined by a cavity of the object.

The second anode may be adapted to at least partially surround the object.

An apparatus according to the disclosure herein for the metallization of a tube may comprise a first inner anode adapted to be at least partially introduced inside the tube, and a second outer anode adapted to at least partially surround the tube, so that the distribution of metallization ions around the object is optimized. Beneficially the inner anode may be surrounded by the tube on the entire length of the tube, and the outer anode may surround the tube on the entire length of the tube.

The thickness of the plated metallic layer on the inner and outer surfaces of the object may be independently adjusted by regulating the current supplied respectively to the inner anode and the outer anode.

The second anode may be adapted to form an outer wall of the container.

The outer wall of the apparatus may be at least partially formed by the outer wall of the container. The rod shaped outer wall of the container may be made of conductive material so as to form an outer anode.

The metallization contact may be at least partially mounted in a sleeve so as to cross a container's wall. This enables accessibility of the metallization contact from the outside of the container's wall.

Such design allows accessibility of the flexible contacts and their easy manipulation from the outside.

The apparatus may be adapted to obtain a laminar flow of electrolyte along the surface of the object. In particular the container and a fluid network and a control of the fluid network are beneficially adapted to obtain a laminar flow of electrolyte along the surface of the object.

The disclosure herein also extends to a method for the metallization of an object comprising:

placing the object at least partially in an electrolyte, placing a first electrode in contact with the electrolyte, placing an electrical contact, called metallization contact, of a second electrode in contact with the object, and applying an electrical tension between the first electrode and the second electrode.

The method comprises displacing the metallization contact in relation to the object during the metallization of the object.

The method may also comprise a step of etching at least part of the surface of the object, so as to obtain an etched surface. The etching may be made chemically for example by dipping the object in a hot chromic acid-sulfuric acid mixture.

The method may also comprise a step of sensitizing at least part of the etched surface of the object, so as to obtain a sensitized surface. This may be obtained for example by dipping the object in a tin chloride solution.

The method may also comprise a step of activating at least part of the sensitized surface of the object, so as to obtain an activated surface. This may be obtained for example by dipping the object in a palladium chloride solution.

The method may also comprise a step of pre-metallizing at least part of the activated surface of the object, so as to obtain a pre-metallized surface. This may be obtained for example by an electroless deposition of copper on the activated surface of the object.

The method may also comprise:

in a first step, contacting a first group of metallization contacts on a surface of the object during a first duration, in a second step, contacting a second group of metallization contacts on a surface of the object during a second duration.

The method may comprise alternating the contact between a first group, a second group and any other number of groups of metallization contacts.

In the second step, the first group of metallization contacts may be separated from the surface of the object The alternating contact between a plurality of groups of metallization contacts allow for a continuous and homogenous metallization layer on the object.

Furthermore, it is possible to clean and surface protect the continuous metallic layer obtained on the object within the apparatus according to the disclosure herein. To do so, the electrolyte in the container may be flushed and a cleaning fluid may be introduced to clean the metal layer on the object. Furthermore, the cleaning fluid may be flushed and a surface protecting fluid may be introduced to protect the surface of the metal layer on the object.

The disclosure herein also extends to other possible combinations of features described in the above description and in the following description relative to the figures. In particular, the disclosure herein extends to an apparatus comprising features described in relation to the method; and the disclosure herein extends to methods comprising features described in relation to the apparatus.

BRIEF DESCRIPTION OF THE DRAWINGS

Some specific example embodiments and aspects of the disclosure herein are described in the following description in reference to the accompanying figures.

DETAILED DESCRIPTION

The complete coverage of an object with a plated layer on both outer and inner surfaces may be achieved by the use of an apparatus as schematically presented in FIGS. 1-4.

Figure 1:
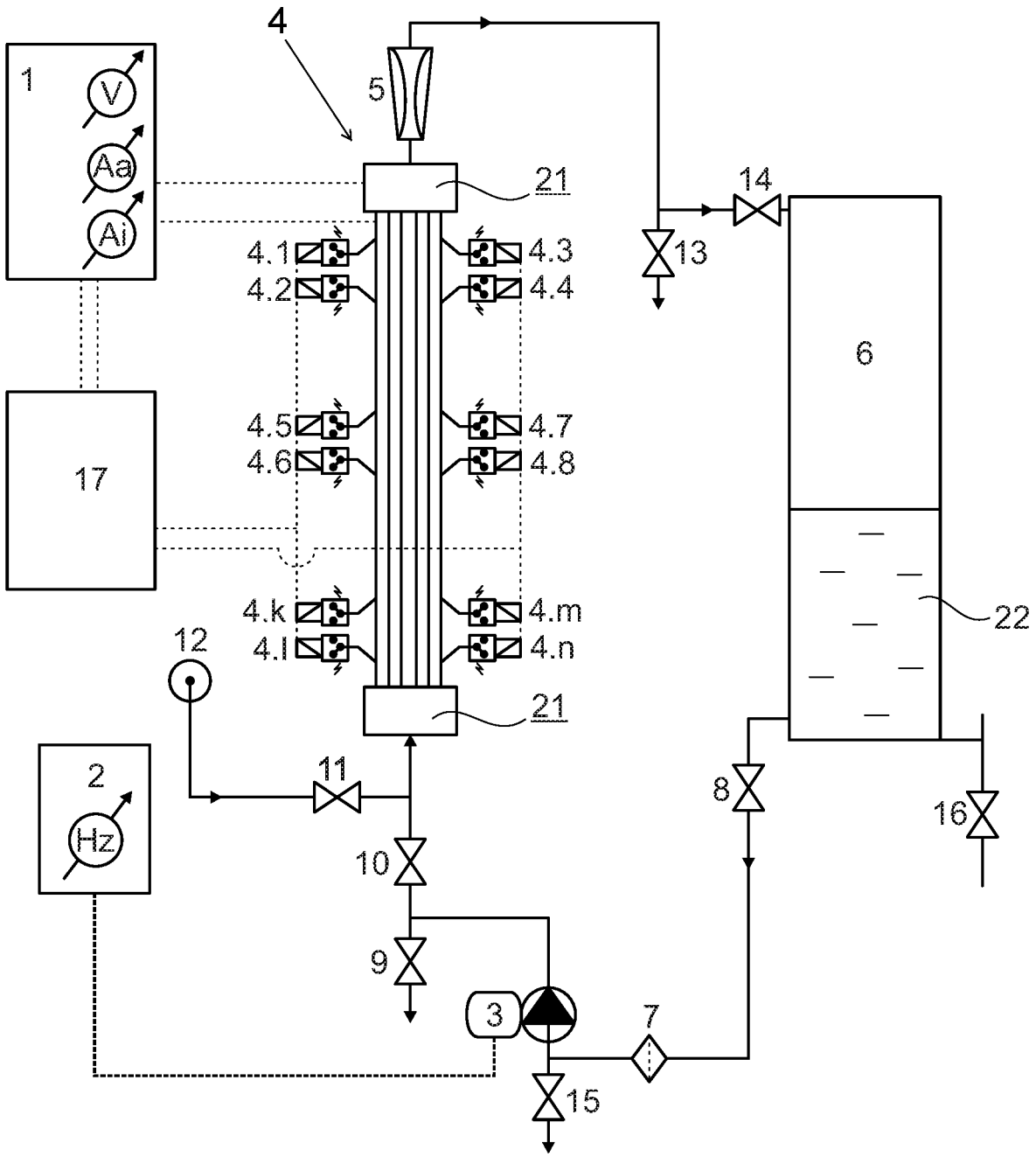
FIG. 1 is a schematic diagram of an apparatus according to the disclosure herein.

In FIG. 1 a schematic diagram of an apparatus according to the disclosure herein is represented comprising: a power source or rectifier 1, a frequency regulator 2 to adjust a speed of a pump 3, an electrolyser 4, a rotameter 5, an electrolyte reservoir 6, a filter 7, valves 8, 9, 10, 11, 13, 14, 15, 16 (together 8-16 in the following text) a water inlet 12, a cathode comprising several metallizing contacts 4.1, 4.2, 4.3, 4.4, 4.5, 4.6, 4.7, 4.8 and **4.*k*, 4.*l*, 4.*m*, 4.*n* (together 4.1-4.*n* in the following text) and their actuator, a controller 17 of the actuators of the metallizing contacts, an inner anode 18, an outer anode 19, an object 20 to be metallized and end-caps 21 at bottom and top of the outer anode 19**.

The electrolyser 4 comprises a container, the anodes 18, 19, the metallizing contacts 4.1-4-*n*, and electrical contacts 18.1, 18.2 of the inner anode 18. The electrolyser also comprises electrical contacts (not represented) for the outer anode 19 which are at the lower end-cap 21 of the electrolyser and which may be similar to the electrical contacts 18.1, 18.2 of the inner anode 18. The container comprises the outer anode 19 and the end-caps 21. The outer anode 19 forms a cylindrical outer wall of the container. In fact, the inner surface of the outer anode 19 functionally forms the anode.

Each end-cap 21 is fluid-tightly mounted on the outer anode 19. Moreover the metallization contacts 4.1-4-*n* are also fluid-tightly mounted on the outer anode 19. The container thus formed is adapted to contain a fluid, and in particular a liquid electrolyte 22.

The end-caps 21 are beneficially made of an electrically insulating material. The end-caps 21 can therefore electrically insulate the inner anode 18 from the outer anode 19 and in some embodiments from the cathodic object 20. In other embodiments than those represented in the FIGS. 1-5 indeed, at least one of the end-cap 21 may be adapted to support the object. To that effect the end-cap(s) may be adapted to mate with objects of a predetermined size on it, or the end-cap(s) may be adapted to adapt to the size and/or shape of the object.

A longitudinal object 20 such as a polymeric cylinder may be placed in the container, and more generally in the electrolyser. The object 20 is beneficially etched, sensitized and activated before being introduced in the electrolyser 4.

The outer anode 19 is adapted to surround a cylindrical object 20. The inner anode 18 is adapted to place a cylindrical object 20 around it. This arrangement is represented on FIGS. 2 and 3.

The inner anode 18 is fixed to the bottom end-cap 21 and to the top end-cap 21 of the electrolyser 4. The inner anode 18 is electrically connected to the rectifier 1 through electrical contacts 18.1 and 18.2 which are mounted to partially cross the top end-cap 21, as represented on FIGS. 2 and 4.

Figure 2:
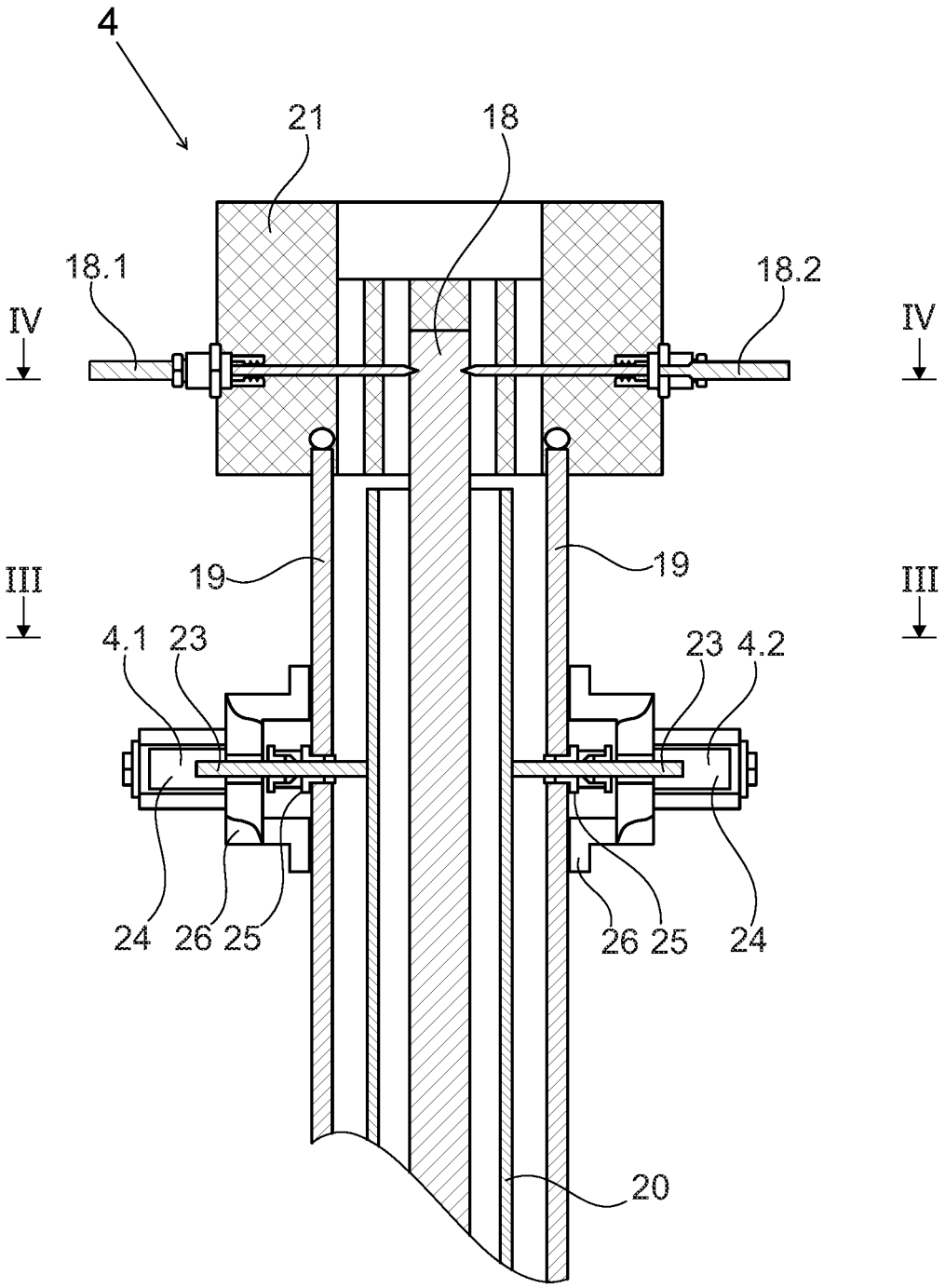
FIG. 2 is a partial representation of a longitudinal cross-section of an embodiment of an apparatus according to the disclosure herein.
Figure 3:
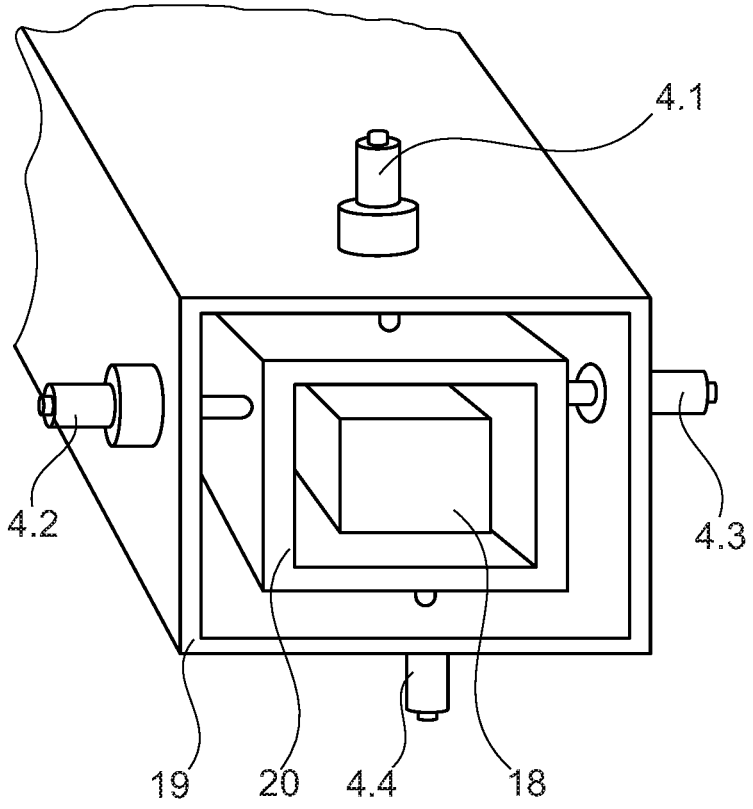
FIG. 3 is a partial representation in perspective of a transversal cross-section of an apparatus according to FIG. 1, along the plane III-III.

The object 20 that needs to be cathodically plated is vertically placed inside the electrolyser as indicated in FIG. 1 and FIG. 2. The object 20 becomes a cathode when at least one of the metallization contacts **4.1-4-*n* which are electrically connected to the cathode of the rectifier 11, contacts the object 20. The apparatus may beneficially be configured so that the object 20 is filled immersed in the electrolyte 22, and in particular so that the container is full of electrolyte 22** during the metallization of the object. This ensures a complete metallization of the object.

The end-caps 21 each comprise at least one inlet port and/or outlet port and a respective fluid connection to place the inlet and/or outlet port in fluid communication with the electrolyte reservoir 6. The inlet and outlet ports may be connected to a fluid network. In the embodiment of FIG. 1 in particular, the top end-cap 21 may comprise an outlet port, while the bottom end-cap 21 comprises an inlet port.

The fluid network comprises valves 8-16 which may be controlled to regulate the fluid flow in the electrolyser 4. The valves 8-16 and therefore the electrolyte flow in the electrolyser 4 may be controlled at least partially. A frequency regulator 2 is adapted to adjust the electrolyte flow rate by controlling the pump 3, based on measurements made by the rotameter 5 connected to the outlet port of the top end-cap 21. The fluid network also comprises a filter 7 for the filtering of the electroplating solution. The working solution is circulated by the pump 3 from the reservoir 6 via the inlet system to the electrolyser 4, rotameter 5 and through the outlet pipeline back to the electrolyte reservoir 6. The laminar flow of the electrolyte is attained by a pump 3 that transports the electrolyte from the reservoir 6 via pipelines and a system of communicating valves 8, 10, 14 and 15. When valves 9, 11, 13 and 16 are closed the electrolyte flows through the bottom connecting part 21 into the electrolyser 4 and leaves it at the rotameter 5. By increase of the frequency of the regulator 2, the electrolyte flow rate can be adjusted and measured by the rotameter 5. In this way, the mandatory laminar flow inside the electrolyser between the outer and inner anodes and outer and inner surfaces of the cathode, respectively, is adjusted.

When the appropriate electrolyte flow is attained, the rectifier 1 and the regulator 17 controlling the current supply of the flexible metallization contacts **4.1-4-*n*** are activated.

Adjustment of the current is achieved by the rectifier 1. In particular the amount of current delivered respectively to the inner anode 18 and to the outer anode 19 may be controlled independently by the rectifier 1. The rectifier is a source of electrical power and may comprise at least a potentiometer. The proper adjustment of the operating electrodeposition parameters as direct plating, pulse plating, etc. is accomplished through the rectifier 1. The current supplied to the cathodic object 20 via the metallization contacts **4.1-4-*n* may be displayed on the rectifier 1 and the electrodeposition process may start. The total current supplied to the anodes 18-19 is the sum of the current supplied to the outer anode 19 and that supplied to the inner anode 18. The current supplied to each anode 18, 19** may be measured and adjusted separately.

The metallization contacts **4.1-4.*n* are sealed on the outer anode 19 so as to cross the wall formed by the outer anode 19. The metallization contacts 4.1-4.*n* each comprise an electrically connecting rod 23. The connecting rod 23 comprises or is made of an electrically conductive material such as copper for example. The connecting rod 23 may beneficially be flexible, in particular elastic in order to be suitable for electrically connecting objects 20 of different sizes and/or shapes. To this effect the connecting rod may for example be made of a rubber coated with a metal. The connecting rod 23 may cross the outer anode 19 at a specific location at which it is mounted in an electrically insulating sleeve 25. The electrically insulating sleeve 25 insulates the connecting rod 23 connected to the cathode, from the outer anode 19. The insulating sleeve 25 is beneficially mounted fluid-tight on the connecting rod 23 and in a hole in the outer anode 19**.

The connecting rod 23 is actuated by an actuator 24 adapted to displace the connecting rod orthogonally to the surface of the outer anode, that is along a radial direction of the electrolyser. The connecting rod 23 and the actuator 24 are mounted in a housing 26. The connecting rod 23 may be brought closer and in contact with the object by the actuator, and may be moved away and separated from the object such that the electrical contact between the connecting rod 23 of a metallization contact and the object may alternatively be established or cut. The actuators 24 of the metallization contacts **4.1-4.*n* are controlled by the controller 17; the controller 17 being itself supplied with power by the rectifier 1. The actuators 24 of the metallization contacts 4.1-4.*n* are beneficially controlled in groups or individually by the controller 17**.

Figure 4:
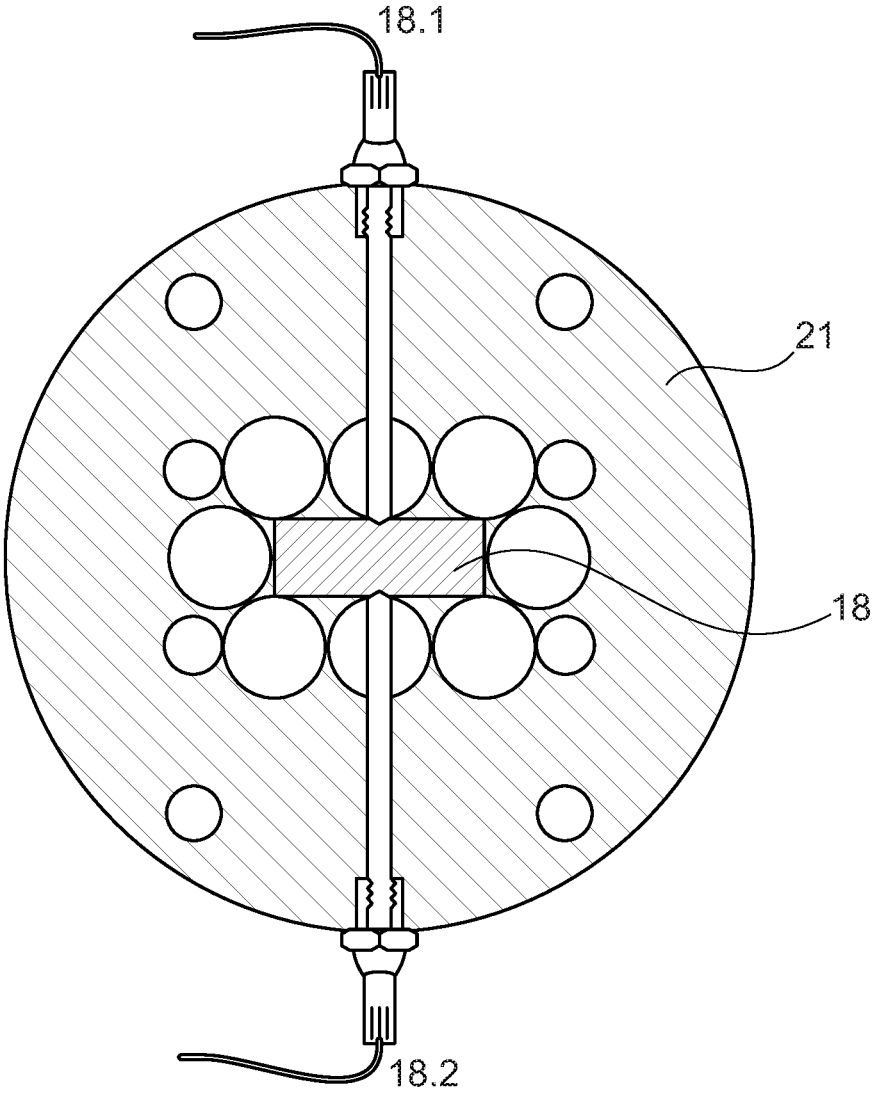
FIG. 4 is a representation of a transversal cross-section of an apparatus according to FIG. 1, along the plane IV-IV.

For example the four metallization contacts 4.1, 4.2, 4.3, 4.4 represented in FIG. 4 may independently be controlled in two groups of two metallization contacts. In a method according to the disclosure herein, a first group comprising two opposite metallization contacts 4.1, 4.4 may in a first step be brought in electrical contact with the object 20, followed by a first phase of a first predetermined duration of metallization of the object. In a second step, the other two metallization contacts 4.2, 4.3 forming a second group are brought in electrical contact with the object 20. In a third step, the metallization contacts 4.1, 4.4 forming the first group are separated from the object 20, followed by a second phase of a second predetermined duration of metallization of the object. Thus, during the first phase, the surface of the object 20 is metallized except at contact locations where the first group of metallization contact 4.1, 4.4 contact the object 20. In the second phase, the contact locations of the first group of metallization contact 4.1, 4.4 are free and in contact with the electrolyte 22, while the second group of metallization contacts 4.2, 4.3 ensures the electrical connection of the object so that it remains the cathode, such that the contact locations of the first group of metallization contact 4.1, 4.4 may also be plated. The contact location of the second group of metallization contacts 4.2, 4.3 has been plated during the first phase of the metallization, such that after the second phase, the entire surface of the object has been metallized. The alternating contact between the first group and the second group may be repeated to obtain a homogenous metallized surface. More specifically, as will be shown in relation with FIG. 5A, 5B, 5C the number of groups and of metallization contacts in each group may vary such that more complex sequence may be envisaged within a method of the disclosure herein.

By continuous change of the operation of the flexible contacts a quasi-contact free electroplating even of the object 20 with high aspect ratio is achieved.

Moreover an apparatus with a high number of metallization contacts is beneficial to obtain a particularly homogeneous metal layer on the object. As an example, by using 20 metallization contacts (or groups of contacts) contacting the object at different positions and operating in a sequence of at least 20 steps, the inventors have determined that it is possible to get 95% of the thickness of the electroplated layer even at the contact location. A smaller thickness variation may be obtained with a higher number of metallization contacts and/or metallization contacts moving along the surface of the object. For example with 50 metallization contacts the inventors estimate that the thickness variations of the electroplated layer may be as low as 2%.

As a matter of fact, the electroplated surface attained in this way does not show any visible scratches or non-plated areas. This is a unique improvement since until now non-plated areas of the cathode are the consequence of using fixed electrical contacts needed to achieve the necessary current. When electrodeposition of the material that is plated is finished, the following steps are carried out: rectifier 1, controller 17 of metallization contact positions, frequency regulator 2 and pump 3 are switched off. Afterwards, the apparatus allows separate outlet of the electrolyte after electroplating followed by an immediate inlet of water into the electrolyser 4 by intake of water (or other cleaning fluid) through the inlet 12 ensuring uniform cleaning even of objects with high aspect ratio. These operations are achieved in the following way: outlet of the electrolyte after deactivation of pump 3, closing of valve 8 followed by the outlet of the electrolyte from the electrolyser 4 back to the reservoir 6. The next steps are closing of valves 10, 14 and 15. Cleaning of the elongated object is achieved by the following operations: opening of valve 11 allowing the inlet of water 12 into the electrolyser 4 and the outlet of the water by valve 13 in its opened position. After cleaning, valve 11 is closed and valve 15 opened to allow complete drain out of water from the electrolyser 4. In a last step, the object can easily be removed by disengaging the top connecting part 21 of the electrolyser 4.

In the embodiments represented, the container is placed vertically. It is of special interest in electroplating to achieve laminar flow and to avoid the negative influence of turbulent flow on the plated layer. In the disclosure herein, the laminar flow is achieved by using a vertically positioned electrolyser and by the adjustments made with the frequency regulator and measured by a rotameter. Therefore, by avoiding any turbulences the optimal laminar flow between the vertically positioned object and inner and outer anodes is accomplished.

Such vertical, symmetric arrangement brings about the necessary uniform access of the electrolyte along both, the outer and the inner surfaces of the objects. Furthermore, this apparatus allows carrying out a multiple step process including the electroplating and surface treatment without removing the object. The latter is especially attractive for industrial applications in terms of reproducibility, process control and cost effectiveness.

As an addition, a surface treatment of non-conductive objects can be carried out with a chemical deposition to achieve a thin, metallic layer. This may be attained by simply changing the working fluid flowing in the container, without displacing the object.

Another advantage of the disclosure herein is that the main part of the apparatus, the electrolyser is not restricted for electroplating only. Without prior removal of the object from the apparatus, the given apparatus can also be used for other processes, as rinsing and protecting of electroplated surfaces with corrosion inhibitor. Furthermore, the apparatus allows not only plating and cleaning of the object without removing it from the electrolyser 4 but also the addition of corrosion inhibitors into the cleaning solution. This is of special interest in the case of copper plating that is known to be very prone to be affected by corrosion.

Figure 5A:
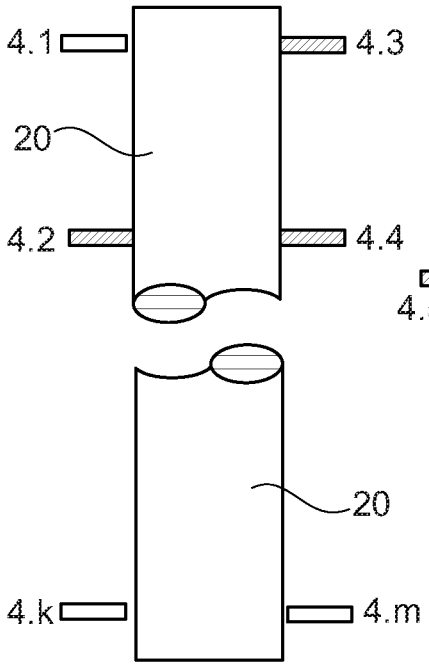
FIGS. 5A, 5B and 5C are simplified partial representations of an object in an apparatus according to the disclosure herein at different stages of a method according to the disclosure herein.
Figure 5B:
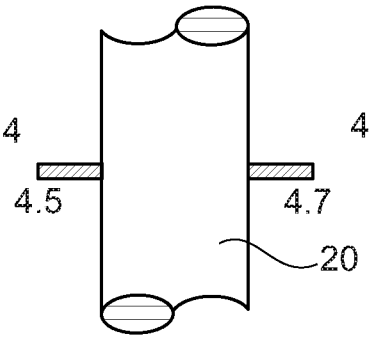
Figure 5C:
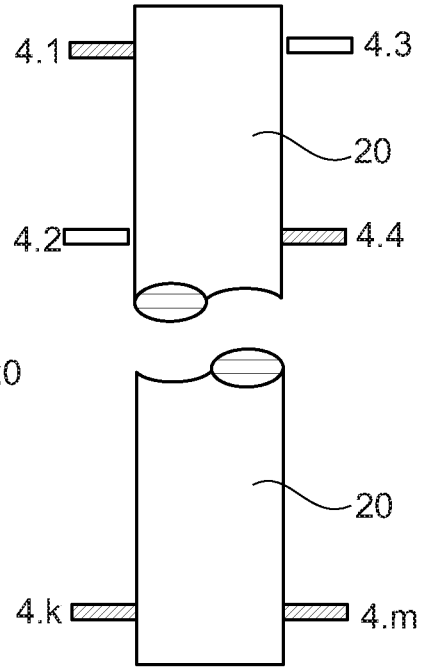

In FIGS. 5A, 5B, 5C an example is given of three steps of a method for the metallization of an object 20 with an apparatus of the type presented in FIG. 1. In this method each metallization contact is actuated individually and independently from the other metallization contacts.

In a first step represented on FIG. 5A, three metallization contacts 4.2, 4.3, 4.4 are in electrical and mechanical contact with the object 20, while another three metallization contacts 4.1, **4.*k*, 4.*m* and other non-represented metallization contacts are separated from the object. During this first step of metallization (or electrodeposition), the surface of the object in front of the separated metallization contacts are metallized, while the contact locations of the surface of the object at which the first three metallization contacts 4.1, 4.*k*, 4.*m*** contact the object are not metallized.

In a second step represented on FIG. 5B, only two other metallization contacts 4.5, 4.7 are in contact with the object while all other metallization contacts (non-represented) are separated from the object, such that the contact locations of the first three metallization contacts 4.1, **4.*k*, 4.*m*** may be metallized.

In a third step represented on FIG. 5C, another three metallization contacts 4.1, 4.4, **4.*k*, 4.*m* are in contact with the object 20**, while all other metallization contacts are separated from the object.

Any other sequence of contact and release between the metallization contacts and the object may be envisaged. However, each metallization contact must be separated from the object during at least one phase of a method according to the disclosure herein to obtain a continuous layer of metal on the object. More particularly, a method according to the disclosure herein may beneficially comprise a much higher number of steps or phases with alternating contacts of a high number of metallization contacts to obtain a highly continuous and homogeneous metal layer on the object.

With no loss of generality, the disclosure herein can be used for electroplating of various surfaces of different materials Ag, Cu, Ni, steel with different plated layers as Ni, Zn, Cr III, Ag, Au etc.

The disclosure herein allows for an easy maintenance and a competitive price of the final product. By replacing the conductive parts of the vertically positioned electrolyser, the proposed apparatus allows in combination with the electroplating also electroless deposition. The disclosure herein therefore presents the advantage of being adapted to be used for plating of both conductive and non-conductive objects even with high aspect ratios.

The disclosure herein was successfully used to carry out complete, continuous metallic deposition of an object completely immersed in the electrolyte. As example, a tube of rectangular cross section having a high aspect ratio (~30) was completely electroplated with Cu on both, the inner and outer surfaces. The layer achieved by plating is continuous. The small thickness variations observed at the site of the contacts in the experiments made by the inventors were caused by the fact that only three groups of contacts, each of them consisting of 4 contacts were used in a sequence. Additional metallization contacts in a higher number of groups and/or applied in a different sequence, in particular in a sequence with more steps would reduce even more the local thickness variations.

The disclosure herein is not limited to the specific embodiments herein disclosed as examples. The disclosure herein also encompasses other embodiments not herein explicitly described, which may comprise various combinations of the features herein described.

While at least one example embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An apparatus for metallization of an object, the apparatus comprising:

a container to contain an electrolyte and at least a portion of the object, the container comprising:

an inner anode adapted to be at least partially within a volume defined by a cavity of the object;

an outer anode that at least partially surrounds the object when the object is positioned within the container; and end-caps mounted on opposing ends of the outer anode in a fluid-tight manner;

wherein the inner anode is directly connected to each of the end-caps and is electrically isolated from the outer anode by the end-caps;

a first electrode; and a second electrode comprising metallization contacts that are each an electrical contact adapted to be electrically in contact with the object, each metallization contact being oriented substantially orthogonally to an outer surface of the object, in a direction orthogonal to a longitudinal direction of the object;

wherein the apparatus is adapted to radially displace the metallization contacts in relation to the outer surface of the object during metallization of the object.

2. The apparatus according to claim 1, comprising an actuator to actuate one or more of the metallization contacts.

3. The apparatus according to claim 2, comprising a controller to control the actuator.

4. The apparatus according to claim 1, wherein the end-caps are mounted directly onto the opposing ends of the outer anode.

5. The apparatus according to claim 1, wherein the metallization contacts are at least six metallization contacts.

6. The apparatus according to claim 3, wherein the second electrode is adapted to displace the metallization contacts in relation to the object during the metallization of the object.

7. The apparatus according to claim 1, comprising a support for supporting the object during the metallization of the object.

8. The apparatus according to claim 1, wherein at least one of the metallization contacts is adapted to at least partially support the object.

9. The apparatus according to claim 1, wherein the metallization contacts comprise:

a first group of metallization contacts adapted to support together the object by contacting simultaneously a surface of the object; and a second group of metallization contacts adapted to support together the object by contacting simultaneously the surface of the object.

10. The apparatus according to claim 1, wherein the metallization contacts are configured for displacement along a surface of the object.

11. The apparatus according to claim 1, wherein the object is entirely contained within the container.

12. The apparatus according to claim 11, wherein the container is entirely filled with the electrolyte.

13. The apparatus according to claim 1, wherein the electrolyte comprises a liquid electrolyte.

14. The apparatus according to claim 1, wherein the object comprises a polymeric object.

15. The apparatus according to claim 14, wherein the object is etched, sensitized, and activated prior to being metallized.

16. The apparatus according to claim 15, wherein the object is entirely contained within the container.

17. The apparatus according to claim 16, wherein the container is entirely filled with the electrolyte.

18. A method for metallization of an object, the method comprising:

forming a container comprising:

an inner anode adapted to be at least partially within a volume defined by a cavity of the object;

an outer anode that at least partially surrounds the object when the object is positioned within the container; and end-caps mounted on opposing ends of the outer anode in a fluid-tight manner;

wherein the inner anode is directly connected to each of the end-caps and is electrically isolated from the outer anode by the end-caps;

filling the container with an electrolyte;

placing the object at least partially in the electrolyte contained within the container;

placing a first electrode in contact with the electrolyte;

placing metallization contacts, which are each an electrical contact of a second electrode, in contact with the object, each metallization contact being oriented substantially orthogonally to an outer surface of the object, in a direction orthogonal to a longitudinal direction of the object;

applying an electrical tension between the first electrode and the second electrode; and radially displacing at least one of the metallization contacts in relation to the object during the metallization of the object.

19. The method according to claim 18, wherein the metallization contacts comprise a first group of metallization contacts and a second group of metallization contacts, the method comprising:

in a first step, contacting the first group of metallization contacts on the outer surface of the object during a first duration; and in a second step, contacting the second group of metallization contacts on the outer surface of the object during a second duration.

20. The method according to claim 19, wherein, in the second step, the first group of metallization contacts is separated from the outer surface of the object.

* * * * *